US007370725B1

(12) United States Patent
Dornfeld

(10) Patent No.: US 7,370,725 B1
(45) Date of Patent: May 13, 2008

(54) MOTORIZED RUNGLESS LADDER

(76) Inventor: Gary R Dornfeld, 523 Alden Ave., Westfield, NJ (US) 07090

( * ) Notice: Subject to any disclaimer, the term of this patent is extended or adjusted under 35 U.S.C. 154(b) by 473 days.

(21) Appl. No.: 11/028,138

(22) Filed: Jan. 3, 2005

(51) Int. Cl.
*E06C 7/12* (2006.01)

(52) U.S. Cl. ..... 182/2.2; 182/2.5; 182/18; 182/37; 182/39; 182/69.6; 182/102; 182/106; 182/116; 182/126; 182/148; 182/194; 187/245; 187/267

(58) Field of Classification Search ..... 182/2.2, 182/2.5, 2.8, 18, 36, 37, 39, 69.6, 101–103, 182/106, 111, 113, 116, 126, 134, 148, 145, 182/194, 141, 91, 12; 187/241, 245, 247, 187/267; 414/541, 545
See application file for complete search history.

(56) References Cited

U.S. PATENT DOCUMENTS

| | | | | | |
|---|---|---|---|---|---|
| 2,880,920 | A | | 4/1959 | Glessner | |
| 2,965,192 | A | | 12/1960 | Balogh | |
| 3,075,611 | A | * | 1/1963 | Baringer | 182/134 |
| 3,115,211 | A | * | 12/1963 | Ostrander, Jr. | 182/103 |
| 3,196,981 | A | | 7/1965 | Winnall | |
| 3,799,289 | A | | 3/1974 | Cecere, Jr. | |
| 4,049,081 | A | | 9/1977 | McDonald et al. | |
| 4,249,634 | A | * | 2/1981 | Potts | 182/91 |
| 4,345,669 | A | * | 8/1982 | Noall | 182/103 |
| 4,396,093 | A | | 8/1983 | Zimmerman | |
| 4,427,094 | A | | 1/1984 | Winkelblech | |
| 4,512,440 | A | | 4/1985 | Bixby | |
| 5,992,572 | A | * | 11/1999 | Gilliland et al. | 182/148 |
| 6,095,284 | A | | 8/2000 | Smith | |
| 6,283,249 | B1 | * | 9/2001 | Young et al. | 182/12 |
| 2006/0182581 | A1 | * | 8/2006 | Murray et al. | 414/541 |

FOREIGN PATENT DOCUMENTS

| | | |
|---|---|---|
| DE | 4233648 | 4/1994 |
| DE | 19937590 | 3/2000 |
| DE | 19938962 | 2/2001 |
| GB | 2.204.628 | 11/1988 |
| JP | 11036763 | 2/1999 |

* cited by examiner

*Primary Examiner*—Richard E. Chilcot, Jr.
*Assistant Examiner*—Matthew Smith
(74) *Attorney, Agent, or Firm*—Michael I. Kroll

(57) ABSTRACT

A device supported by a ground surface and a structure for at least one of elevating and descending a user. The device includes a first guide rail having a first channel extending along a length thereof and a second guide rail having a second channel extending along the length thereof. At least one connector connects the first guide rail with the second guide rail at a predetermined location along a length thereof so that said first channel and said second channel face inwards towards each other. A platform for supporting the user having a predetermined amount of weight is connected within each of the first and second channels and between the first guide rail and second guide rail. The device further includes means for moving the platform along the length of each of the first channel and the second channel. Upon the moving means being engaged by a user, the platform is moved distally towards at least one of a first end of the guide rails and a second end of the guide rails opposite the first end thereby moving the user therealong.

23 Claims, 10 Drawing Sheets

MOTORIZED RUNGLESS LADDER

BACKGROUND OF THE INVENTION

1. Field of the Invention

The present invention relates generally to ladders and, more specifically, to a motorized rungless ladder having a pair of rails joined by a plurality of panels. Within each rail is an actuatable drive mechanism having drive engaging members. At least one motor powered by AC and/or DC current engages an ascending/descending means driving the platform's drive engaging members. In addition, a portable handheld control can be used from a remote location to engage and disengage platform movement. The DC battery power may be rechargeable through removal of a battery pack or connectable to a charger.

2. Description of the Prior Art

Numerous other ladder designed for the same purpose exist in the prior art. Typical of these are U.S. Pat. Nos. 2,880,920; 2,965,192; 3,196,981; 3,799,289; 4,049,081; 4,396,093; 4,427,094; 4,512,440; and 6,095,284; German Patent No. DE4233648; DE19937590; and DE19938962; U.K. Patent No. GB2204628; and Japanese Patent No. JP11036763.

U.S. Pat. No. 2,880,920

Inventor: Lee S. Glessner

Issued: Apr. 7, 1959

An extensible stepladder comprising an extensible ladder member and an extensible prop member, said ladder member and said prop member each comprising upper and lower linearly slidably interconnected sections, a horizontal shaft rotatably supported at the upper end of one of said upper sections, the other upper section being pivotally connected at its upper end to said first upper section for swinging movement about the axis of said shaft, a jack screw rotatably journalled and axially fixed on each said upper section, intermeshing gearing on said shaft and each of said screws operative to cause rotation together of said shaft and said screws, a nut fixed on each said lower section in threaded engagement with a screw of its respective upper section to cause simultaneous relative sliding movement between the sections of said members incident to rotation of said screws, and means for rotating said shaft.

U.S. Pat. No. 2,965,192

Inventor: Roy O. Balogh

Issued: Dec. 20, 1960

In an aerial ladder comprising an upright pedestal, a ladder-supporting framework pivotally mounted on the pedestal for rotation about a substantially vertical axis, a main ladder section pivotally mounted on and carried by the framework for rocking movement about an axis transverse to the upright axis, said main ladder section being provided with edgewise aligned spaced pulleys, a second ladder section slidably mounted on the main ladder section for telescopic movement with respect thereto, and an endless driving cable connected to the second ladder section and operatively trained around the pulleys of the main ladder section, the combination with a reversible fluid-motor drivingly connected to one of said pulleys and adapted to have a maximum torque output for high loads and a torque output which adjusts to the requirements of the load when the maximum torque is not required, of means for supplying said motor with a fluid having constant volume flow under varying pressures for driving said motor, and means for cutting off the supply of fluid to said motor when the pressure of the fluid supplied to said motor exceeds a predetermined value.

U.S. Pat. No. 3.196,981

Inventor: Whitford Winnall

Issued: Jul. 27, 1965

An adjustable ladder comprising an upper section and a lower section, front stiles and rear stiles on each said section, the front stiles on the upper section slidably engaging the front stiles on the lower section, the rear stiles of the upper section slidably engaging the rear stiles of the lower section, a first hydraulic ram between the upper and lower front sections, a second hydraulic ram between the upper and lower rear sections, hydraulic pump means on the ladder, valve means between the pump means and the rams, valve control means at the upper end of the front ladder section, a series of rungs between said front stiles of said upper section, a pair of lower pulleys one on each of the lower ends of said front stiles on the lower section, a pair of upper pulleys attached to the upper end of said first hydraulic ram and a flexible ladder comprising flexible side members and rigid rungs; each flexible side member being secured at both its ends to the lower end of said upper section but passing over an upper and a lower said pulley.

U.S. Pat. No. 3,799,289

Inventor: Joseph A. Cecere, Jr.

Issued: Mar. 26, 1974

A self-standing, collapsible stepladder including laterally spaced side members or rails supporting therebetween a platform for movement up and down along the rails for raising and lowering a load, and having actuating means accessible to an operator on the platform.

U.S. Pat. No. 4,049,081

Inventor: Walter McDonald

Issued: Sep. 20, 1977

An elevatable operator-actuated lifting device, including a lower support frame and a platform section telescopically interfitted with the support frame as to be elevatable with respect thereto. Hydraulically actuated piston and cylinder means are provided for telescoping and de-telescoping the platform section with respect to the support frame, to enable elevation and lowering of the platform section. Means moveable with the platform section, including a manually actuated hydraulic pump, enable pressurization and depressurization of the piston and cylinder means, to thereby enable raising and lowering of the platform section by an operator standing thereupon.

U.S. Pat. No. 4,396,093

Inventor: Mahlon N. Zimmerman

Issued: Aug. 2, 1983

A ladder or boom extension system includes a base section, at least one movable section in telescoping arrangement with the base section, and a piston rod fixedly connected longitudinally of the base section. A double acting hydraulic cylinder is movable relative to the piston rod in response to the application of hydraulic forces on either side of a fixed piston. A crosshead including cable carrying pulleys is affixed at each end of the hydraulic cylinder whereby the cylinder and the crossheads travel as a unit for extension and retraction while tensioning in response to hydraulic forces. Extension and retraction cables interconnect between the base section and the movable section and are trained about the crosshead pulleys to pull the movable section toward or away from the base section. The crosshead pulleys tension the cables upon longitudinal movement of the cylinder to either extend or retract the movable section or sections relative to the base section as the cylinder is longitudinally urged along the piston rod.

U.S. Pat. No. 4,427,094

Inventor: Dean R. Winkelblech

Issued: Jan. 24, 1984

This invention is an electrically powered movable elevator device comprised of a base mounted on wheels upon which is mounted a substantially vertical hollow support member through which a screw passes. A support nut attaches to a platform and engages the screw. An electrical control system attached to the platform allows a person standing thereon to be raised or lowered by the rotation of the screw. A reversible electric motor is belt-coupled to the screw which may be made to rotate in either direction, by the electrical control system.

U.S. Pat. No. 4,512,440

Inventor: Lawrence B. Bixby

Issued: Apr. 23, 1985

A rungless motorized ladder of a type having an elongated pole with a cable attached at the top thereof. At the bottom thereof, the cable is attached to a spool which is motorized. The spool is attached to a carriage having a place for receiving a person's feet. Foot controls are provided on such carriage for permitting persons utilizing the device to move the carriage up or down on the pole with a simple movement of one foot. Likewise, when the foot control is not being utilized, an automatic braking device is provided for holding the carriage securely in a stationary position.

U.S. Pat. No. 6,095,284

Inventor: Elwaine Smith

Issued: Aug. 1, 2000

An elevatable stand construction 10 for physically challenged hunters which includes a ladder style main framework member 20 supported in an upwardly angled disposition, a chair style platform member 30 slidably disposed on the main framework member 20, and a mechanized unit 13 for moving the platform member 30 in an up and down fashion relative to the main framework member 20. The mechanized unit 13 may comprise a manual version 40 or a motorized version 50.

German Patent Number DE4233648

Inventor: Werner Isfort

Issued: Apr. 7, 1994

The ends of the movable rung (3) are pref. fixed to sliding carriages or carriages slidable in the uprights (1). Each endface of the rung is mounted on at least two, spaced rollers (4) slidable along respective grooves (5) in the uprights. The drive is pref. provided by an electromotor (6) with its shaft rolling up a belt (7) coupled directly or indirectly to the rung. The motor is connected to the mains or an accumulator. Arrestors are activated when the motor is off. A tool holder (8) is provided in parallel with the rung and slidable up or down. The holder can have, or provide, an electrical connection.

ADVANTAGE—Easier to set up in confined space. Saves climbing up and down and carrying tools at the same time.

German Patent Number DE19937590

Inventor: Kastriot Merlaku

Issued: Mar. 2, 2000

The ladder fixing system includes a belt (2), which is integrated at the top of the ladder (1), for fixing the ladder at a leaning point at a wall or similar. The belt can be secured by a buckle or by a felt fastener. An integrated small electric motor (4) is set in motion, at the part of the ladder using a fixing mechanism, which consists of several arc shaped parts (5). The power supply to the motor results using accumulators (6), which are located in the lower part of the ladder. An integrated illumination (7) is provided at the top part. A plug box is fitted for the current lead installed in the ladder, and the lead is not visible from the outside.

German Patent Number DE19938962

Inventor: Werner Dubiel

Issued: Feb. 22, 2000

The mobile step ladder (100) has rollers (111) at the under side, powered by a drive (110) to move the ladder (100). A portable power tool, such as a power screwdriver (300), is connected to the drive (110) for the movement, from the tool holder (130) at the head (105) of the assembly. The roller drive (110) is a braked gearing, a friction drive or a self-locking gearing.

U.K. Patent Number GB2204628

Inventor: Edward Donald Smallwood

Issued: Nov. 16, 1988

A roof ladder frame to fit onto a tower frame, has two adjustable legs 11 and a rotatable centre bar 14 onto which two lugs 13 are mounted for fitting of a ladder. A plate (20, FIG. 2) to accommodate a hydraulic piston (19) mounted thereon by a swivel pin (22) and onto the side of the roof ladder frame. The other end of the hydraulic piston (19) is connected to the swivel bar 14 into a bottom lug 17. When the hydraulic piston is fully extended, the lugs 13 will be in an upright position and the roof ladder frame is inserted onto the tower frame. The legs 11 are adjusted so that the centre bar 14 does not foul the roof. A ladder is secured to lugs 13. By releasing bleed screw (21), the ladder descends to the apex of the roof. To return the ladder the bleed screw (21) is closed. The pump handle 23 can fully extend the hydraulic piston, which is the horizontal position for the ladder.

Japanese Patent Number JP11036763

Inventor: Hajime Watabe

Issued: Feb. 9, 1999

To improve safety by surely supporting the body by hand up to a transfer onto an upper floor at the time of ascent to the upper floor from a lower floor, and to assume a lowering posture safely on the upper floor even at the time of lowering onto the lower floor from the upper floor.

In the automatic ladder device H, a peripherally moved chain device 2 for footsteps installed in the vertical direction, a plurality of footstep bars 26 mounted in the peripherally moved direction of a chain, a peripherally moved chain device 3 for handles set up in the vertical direction in the vicinity of the peripherally moved chain device 2 for the footsteps, a plurality of the handles 36 fitted in the peripherally moved direction of the chain and a driving device 4 peripherally moving the chains of the peripherally moved chain device 2 for the footsteps and the peripherally moved chain device 3 for the handles synchronously and controlling driving and stop are installed. The upper end section of the chain of the peripherally moved chain device 3 for the handles is set at a place higher than the upper end section of the chain of the peripherally moved chain device 2 for the footsteps, and set at a place higher than the floor face of an upper floor at the time of mooting.

SUMMARY OF THE PRESENT INVENTION

The present invention relates generally to ladders and, more specifically, to a motorized rungless ladder having a pair of rails joined by a plurality of panels. Within each rail is an actuatable drive mechanism having drive engaging members. At least one motor powered by AC and/or DC current engages an ascending/descending means driving the platform's drive engaging members. In addition, a portable handheld control can be used from a remote location to engage and disengage platform movement. The DC battery power may be rechargeable through removal of a battery pack or connectable to a charger.

A primary object of the present invention is to provide a ladder with a motorized platform that overcomes the shortcomings of the prior art.

Another, secondary object of the present invention is to provide a ladder with a motorized platform that selectively ascends and descends in response to user control.

Another object of the present invention is to provide a motorized rungless ladder wherein the motorized platform is able to support a user weighing a predetermined amount.

Still another object of the present invention is to provide a motorized rungless ladder wherein the motorized platform includes at least one of a non-slip surface and toe guard abutment.

Another object of the present invention is to provide a motorized ladder formed from two rails secured together by a plurality of support panels each secured at a predetermined location along the length of the rails Still another object of the present invention is to provide a motorized ladder including a power source.

Another object of the present invention is to provide a motorized ladder wherein the power source includes at least one of an AC power cord for connection to a wall outlet, and at least one DC rechargeable battery pack, and a 12V vehicle adapter port.

Yet another object of the present invention is to provide a motorized ladder wherein the rails each include a worm gear for driving the platform along the length of the rails.

Still yet another object of the present invention is to provide a motorized ladder including a control mechanism for engaging and disengaging the motor.

Yet another object of the present invention is to provide a motorized ladder wherein the rails incorporate a kill switch for disengaging the motor.

Another object of the present invention is to provide a motorized ladder wherein the guide rails include hand rails connected on a first edge thereof for providing support to the user.

Another object of the present invention is to provide a motorized ladder wherein the control means includes a portable handheld remote control for selectively engaging the motor and causing the platform to move via the worm gears along the length of the guide rails.

Yet another object of the present invention is to provide a motorized ladder wherein the rails includes at least one of a tilt sensor, a comparator, and alarm mechanism.

Still yet another object of the present invention is to provide motorized ladder wherein the platform has a leveling mechanism ensuring horizontal pitch prior to operation.

Yet another object of the present invention is to provide a motorized ladder wherein the rails include electromagnets for selectively causing the platform to move along the length of the guide rails.

Additional objects of the present invention will appear as the description proceeds.

The present invention overcomes the shortcomings of the prior art by providing a motorized rungless ladder having a pair of rails spaced apart and conjoined by a plurality of panels with a movable platform located between the rails and a handrail fastened to and coextending with the rails. The material used to manufacturer the ladder can be non-conductive to eliminate "shock" potential or shorting hazards to the user. Within each rail is an actuatable drive mechanism having drive engaging members on opposing ends of said platform and a control mechanism for activating and deactivating the movable platform. At least one motor powered by AC and/or DC current engages a drive mechanism which causes the platform to be moved along the length of the guide rails. In addition, a portable handheld control can be used from a remote location to engage and disengage platform movement. The DC battery power may be rechargeable through removal of a battery pack or connectable to a charger. Furthermore, the present invention provides platform leveling mechanism to compensate for site specific ladder pitch during use. Also, the present invention includes a sensor for detecting tilt and an alarm for warning of any detected tilt outside predefined parameters.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
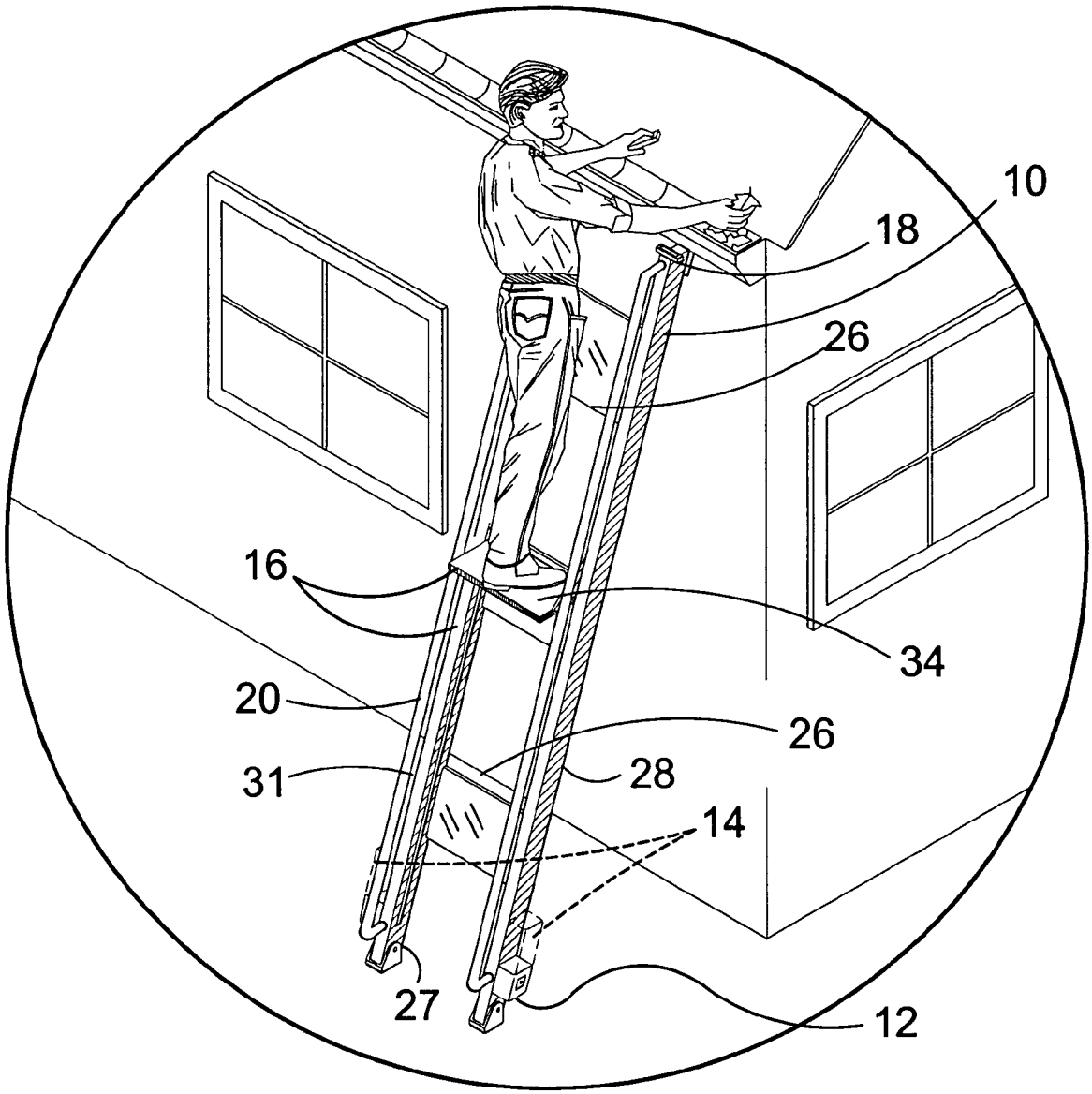
FIG. 1 is an illustrative view of the motorized rungless ladder of the present invention elevating an individual.

Turning now descriptively to the drawings, in which similar reference characters denote similar elements throughout the several views, the Figures illustrate the motorized rungless ladder used to elevate an individual. With regard to the reference numerals used, the following numbering is used throughout the various drawing Figures.

10 motorized rungless ladder of the present invention
12 AC power cord
14 DC rechargeable battery packs
16 non-conductive materials
17 wall brace
18 tilt sensor
19 feet
20 hand rail
21 pivot
22 kill switch
26 support connectors
27 first guide rail
28 second guide rail
29 manual control unit
30 remote control device
31 channel
32 worm gear motor
33 motor
34 elevator platform
35 receiver
36 platform leveling device
37 control signal
38 non-slip surface
39 switch
40 first guide member
42 platform pivoting
44 toe guard abutment
46 second guide member
48 worm gear
50 AC plug port
52 12V vehicle adapter ports
54 electromagnets
56 processor
58 inductors

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments Practitioners skilled in the art will recognize numerous other embodiments as well. For definition of the complete scope of the invention, the reader is directed to appended claims.

Turning now descriptively to the drawings, in which similar reference characters denote similar elements throughout the several views, FIGS. 1 through 10 illustrate a motorized rungless ladder of the present invention which is indicated generally by the reference numeral 10.

In the home improvement industry it is known that certain building supply features appeal to certain customers. The present invention relates to customers who desire ladders with platforms that can be automatically elevated along vertical supports to a specific height. It is known to those in the home improvement industry that climbing up and down a ladder is cumbersome, time consuming, and tiring. The present invention aims to solve that problem by providing a motorized rungless ladder.

FIG. 1 is an illustrative view of the motorized rungless ladder of the present invention elevating an individual. The motorized rungless ladder 10 of the present invention includes a first guide rail 27 and a second guide rail 28 that are parallel to one another. The guide rails 27, 28 are connected to one another at predetermined positiones along the length thereof by a plurality of support connectors 26. The guide rails 27, 28 further includes a channel 31 extending at least partially therethrough on an edge of the guide rails 27, 28 that face each other. The channels 31 extend along a length of the guide rails 27, 28. Positioned between the first guide rail 27 and second guide rail 28 and within the channel 31 of each thereof is an elevator platform 34. The elevator platform 34 is preferably formed from a rigid material that is able to fully support a predetermined weight of a human being. The channels 31 in the guide rails 27, 28 further include a drive mechanism for moving the elevator platform 34 along a length of the channel 31 of the guide rails 27, 28. This will be discussed hereinafter with specific reference to FIGS. 4, 5, 8 and 9.

At least one of an AC power cord 12 and DC rechargeable battery packs 14 are mounted on an edge opposite the channel 31 of each of the first guide rail 27 and second guide rail 28. The AC power cord 12 allows the user to plug the ladder into an outlet for providing power thereto while the DC rechargeable battery packs 14 allow for the ladder to be used when power outlets are not easily accessible. Additionally, the AC power cord 12 allows for the DC rechargeable battery packs to be charged when connected to an outlet.

Additionally, hand rails 20 are attached to each of the first and second guide rails 27 and 28, respectively, on an outer edge thereof. The hand rails 20 assist the user in maintaining his balance while standing on the elevator platform 34 when the platform 34 is at least one of locked in place and moving along the length of the channels 31. Furthermore, positioned along the top edge of the second guide rail 28 is a tilt sensor 18 for selectively monitoring the position of the motorized rungless ladder 10 of the present invention. The tilt sensor 18 is able to sense whether the ladder 10 tilts beyond a predetermined point and further includes an alarm mechanism (not shown) for alerting the user that the sensor 18 has detected a more than acceptable tilt level.

Figure 2:
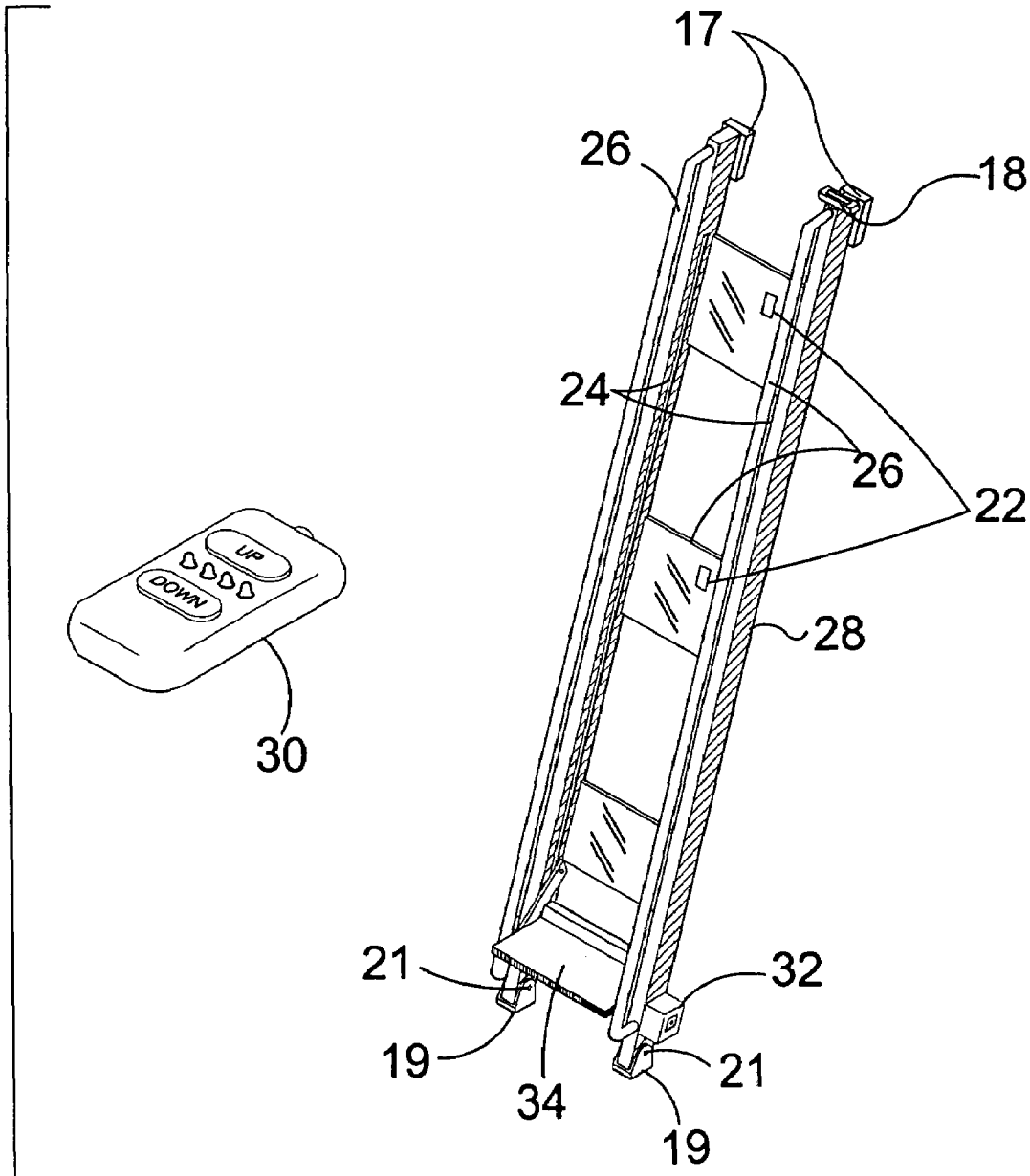
FIG. 2 is an illustrative view of a remote control device and the motorized rungless ladder of the present invention.

FIG. 2 is an illustrative view of a remote control device and the motorized rungless ladder of the present invention. The motorized rungless ladder 10 of the present invention includes the first guide rail 27 and the second guide rail 28 that are parallel to one another. The guide rails 27, 28 are connected to one another at predetermined positiones along the length thereof by a plurality of support connectors 26. The guide rails 27, 28 further includes channels 31 extending at least partially therethrough on an edge of the guide rails 27, 28 that face each other. The channels 31 extending along the length of the guide rails 27, 28. Positioned between the first guide rail 27 and second guide rail 28 and within the channel 31 of each thereof is the elevator platform 34. The elevator platform 34 is preferably formed from a rigid material that is able to fully support a predetermined weight of a human being. The channels 31 in the guide rails 27, 28 further include a drive mechanism 32 for moving the elevator platform 34 along a length of the channel 31 of the guide rails 27, 28. The drive mechanism 32 is mounted on the outer edge of each of the guide rails 27, 28 and is preferably a motor for selectively engaging a worm-gear mechanism positioned within the channels 31 thereby causing the platform 34 to move in a specified direction along a length thereof. The motorized rungless ladder 10 further includes at least one kill-switch 22 electrically connected to each of the drive mechanisms 32. A user may selectively depress the kill switch 22 in order to disengage the drive mechanism 32 and prevent movement of the platform 34. As shown the kill switch 22 is positioned on a face side of the support connectors 26 so as to allow easy access. However, the kill switch 22 may be positioned in any location on the ladder 10 of the present invention that allows the user to have easy access thereto.

Additionally, hand rails 20 are attached to each of the first and second guide rails 27 and 28, respectively, on an outer edge thereof. The hand rails 20 assist the user in maintaining his balance while standing on the elevator platform 34 when the platform 34 is at least one of locked in place and moving along the length of the channels 31. Furthermore, positioned along the top edge of the second guide rail 28 is a tilt sensor 18 for selectively monitoring the position of the motorized rungless ladder 10 of the present invention. The tilt sensor 18 is able to sense whether the ladder 10 tilts beyond a predetermined point and further includes an alarm mechanism (not shown) for alerting the user that the sensor 18 has detected a more than acceptable tilt level.

The ladder 10 of the present invention further includes a remote control device 30. The remote control device 30 is utilized to at least one of engage and disengage the drive mechanism 32. The remote control device 30 causes the worm gear motor 32 to move the elevator platform 34 along the channel 31 of the guide rails 27, 28. The remote control device 30 provides a variable speed mode that controls the speed at which the platform 34 is moved along the length of the channel 31.

The ladder 10 of the present invention further includes feet 19 connected to a bottom edge of each of the first guide rail 27 and second guide rail 28 by a pivot 21. The feet 19 are placed on a flat surface thereby supporting the ladder 10 and any user on the platform 34. The feet 19 can selectively pivot about the pivot 21 thereby allowing for more stability. The ladder 10 of the present invention also includes wall brace 17 mounted on a top edge of each of the first guide rail 27 and second guide rail 28. The wall brace 17 contacts the surface of a structure which the user seeks to climb. Preferably, the feet 19 and the brace 17 are formed from non-slip materials that are not electrically conductive thereby preventing unwanted electrical shock that might result from movement of the ladder 10 in combination with the activity of the drive mechanism 32.

Figure 3:
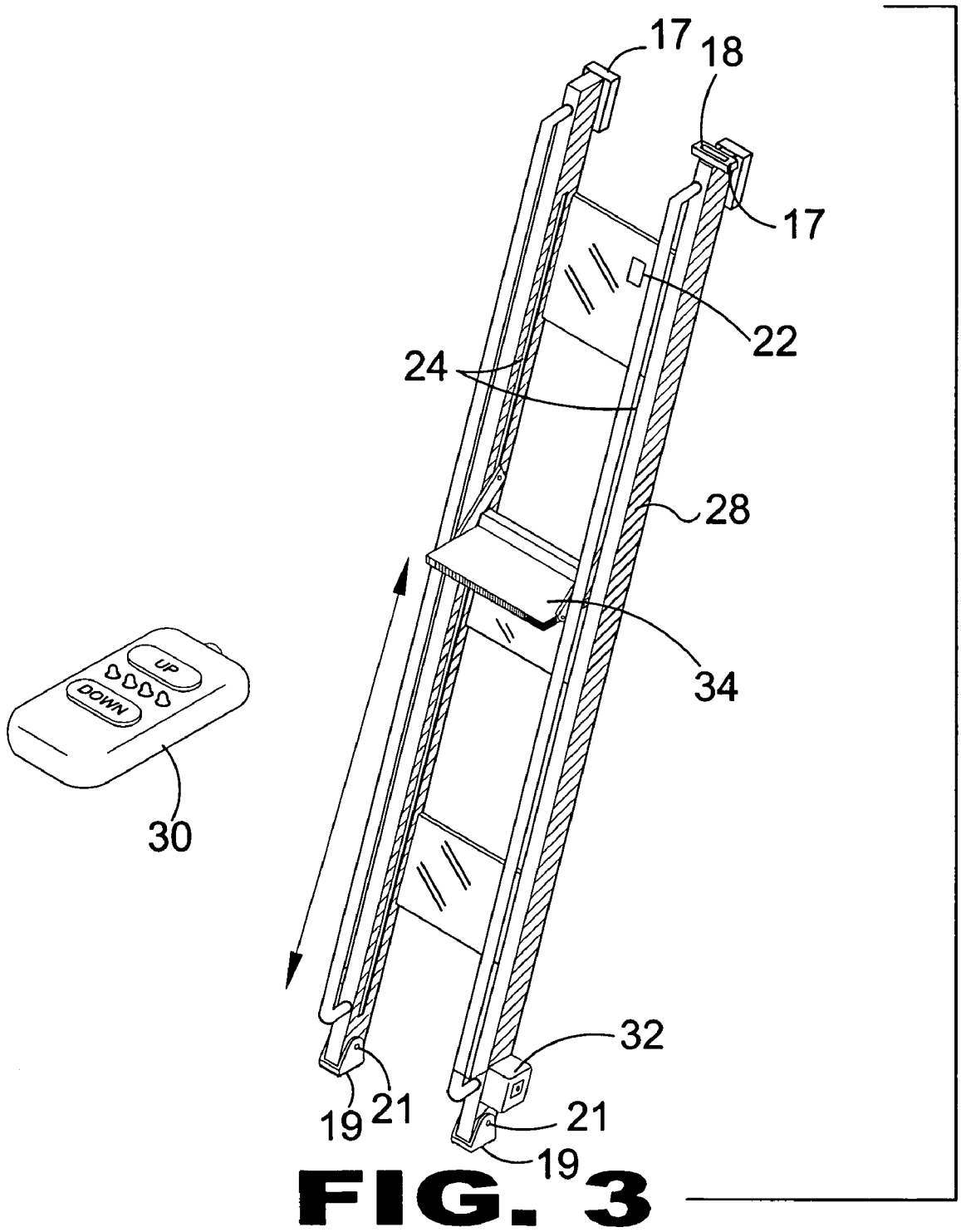
FIG. 3 is an illustrative view of the remote control device and the motorized rungless ladder of the present invention.

FIG. 3 is an illustrative view of the remote control device and the motorized rungless ladder of the present invention. The motorized rungless ladder 10 of the present invention includes the first guide rail 27 and the second guide rail 28 that are parallel to one another. The guide rails 27, 28 are connected to one another at predetermined positiones along the length thereof by a plurality of support connectors 26. The guide rails 27, 28 further includes channels 31 extending at least partially therethrough on an edge of the guide rails 27, 28 that face each other. The channels 31 extending along the length of the guide rails 27, 28. Positioned between the first guide rail 27 and second guide rail 28 and within the channel 31 of each thereof is the elevator platform 34. The elevator platform 34 is preferably formed from a rigid material that is able to fully support a predetermined weight of a human being. The channels 31 in the guide rails 27, 28 further include a drive mechanism 32 for moving the elevator platform 34 along a length of the channel 31 of the guide rails 27, 28. The drive mechanism 32 is mounted on the outer edge of each of the guide rails 27, 28 and is preferably a motor for selectively engaging a worm-gear mechanism positioned within the channels 31 thereby causing the platform 34 to move in a specified direction along a length thereof. The motorized rungless ladder 10 further includes at least one kill-switch 22 electrically connected to each of the drive mechanisms 32. A user may selectively depress the kill switch 22 in order to disengage the drive mechanism 32 and prevent movement of the platform 34. As shown the kill switch 22 is positioned on a face side of the support connectors 26 so as to allow easy access. However, the kill switch 22 may be positioned in any location on the ladder 10 of the present invention that allows the user to have easy access thereto.

Additionally, hand rails 20 are attached to each of the first and second guide rails 27 and 28, respectively, on an outer edge thereof. The hand rails 20 assist the user in maintaining his balance while standing on the elevator platform 34 when the platform 34 is at least one of locked in place and moving along the length of the channels 31. Furthermore, positioned along the top edge of the second guide rail 28 is a tilt sensor 18 for selectively monitoring the position of the motorized rungless ladder 10 of the present invention. The tilt sensor 18 is able to sense whether the ladder 10 tilts beyond a predetermined point and further includes an alarm mechanism (not shown) for alerting the user that the sensor 18 has detected a more than acceptable tilt level.

The ladder 10 of the present invention further includes a remote control device 30. The remote control device 30 is utilized to at least one of engage and disengage the drive mechanism 32. The remote control device 30 causes the worm gear motor 32 to move the elevator platform 34 along the channel 31 of the guide rails 27, 28. The remote control device 30 provides a variable speed mode that controls the speed at which the platform 34 is moved along the length of the channel 31.

The ladder 10 of the present invention further includes feet 19 connected to a bottom edge of each of the first guide rail 27 and second guide rail 28 by a pivot 21. The feet 19 are placed on a flat surface thereby supporting the ladder 10 and any user on the platform 34. The feet 19 can selectively pivot about the pivot 21 thereby allowing for more stability. The ladder 10 of the present invention also includes wall brace 17 mounted on a top edge of each of the first guide rail 27 and second guide rail 28. The wall brace 17 contacts the surface of a structure which the user seeks to climb. Preferably, the feet 19 and the brace 17 are formed from non-slip materials that are not electrically conductive thereby preventing unwanted electrical shock that might result from movement of the ladder 10 in combination with the activity of the drive mechanism 32.

Figure 4:
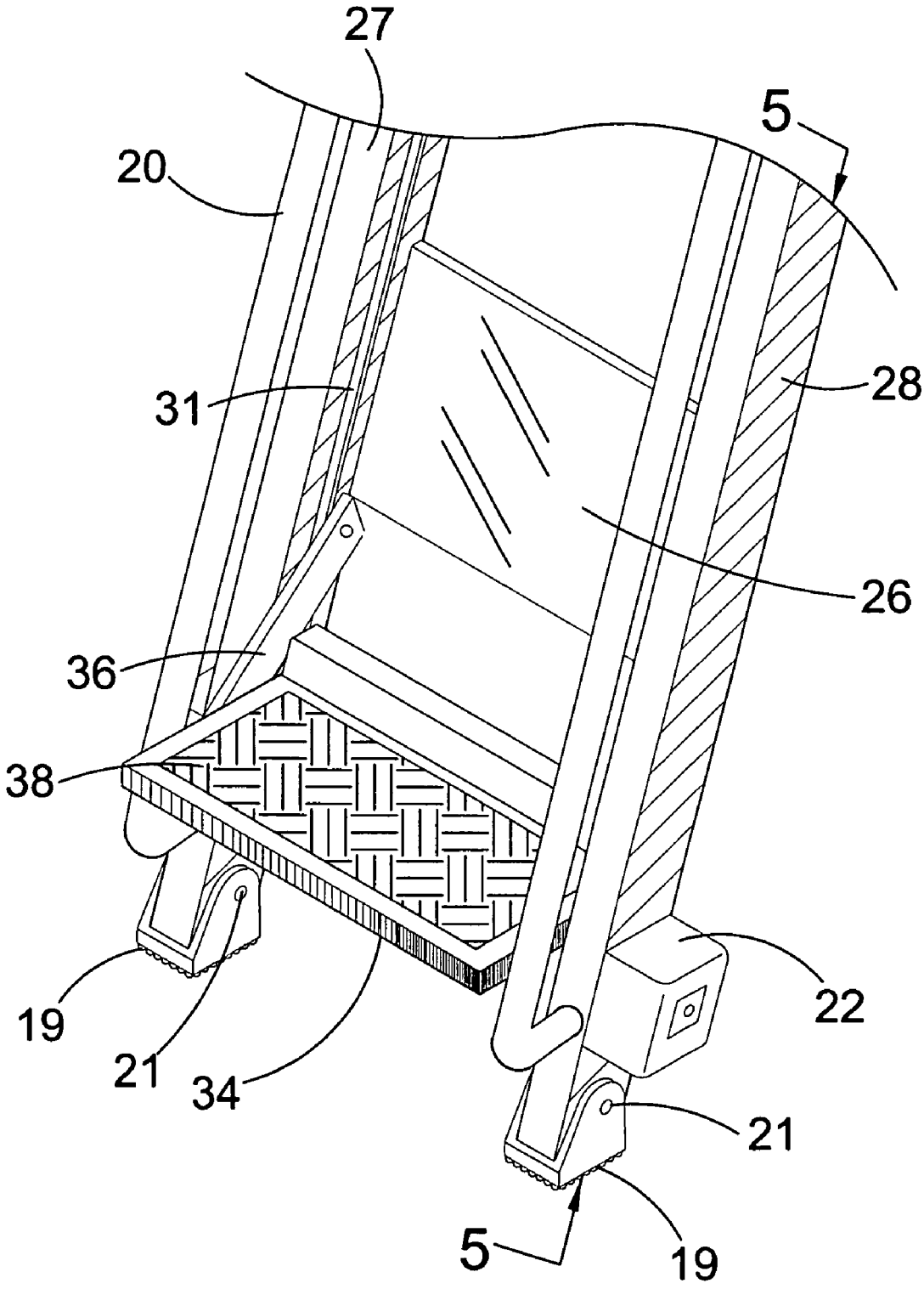
FIG. 4 is a detailed view of showing the movement of the elevator platform and the leveling mechanism of the present invention.

FIG. 4 is a detailed view of showing the movement of the elevator platform and the leveling mechanism of the present invention. The ladder 10 of the present invention includes two guide rails 27, 28 having channel 31 extending partially through an inner edge thereof. The channel 31 in the first rail 27 faces the channel 31 in the second rail. The guide rails 27,28 are connected at predetermined positions along the length thereof by support connectors 26. The guide rails 27, 28 further include handlebars 20 connected on an outer top edge thereof. The handlebars 20 extend along the length of the outer top edge of the rails 27,28. The guide rails 27,28 have pivotable feet connected thereto by pivot 21. The feet 19 pivot about the pivot 21 and contact the ground so that the feet 19 rest flat on the ground thereby providing enhanced stability.

The elevator platform 34 is connected within the channels 31 by a leveling device 36. The platform leveling device 36 ensures that the elevator platform 34 remains flat such that the user can easily balance on the platform 34. The elevator platform 36 is covered in a non-slip surface 38 to provide traction for the user.

The drive mechanism 32 is connected on the outer edge of each of the first guide rail 27 and second guide rail 28 and includes a motor for causing the platform 34 to move along the length of the channel 31. Upon engagement of the motor of the drive mechanism 32, the platform 34 is caused to move. The leveling device 26 causes the platform 34 to move along the length of the channel 31 while maintaining the platform at a predetermined angle with respect to the horizon thereby ensuring that the user is balanced on the platform 34 as it moves.

Figure 5:
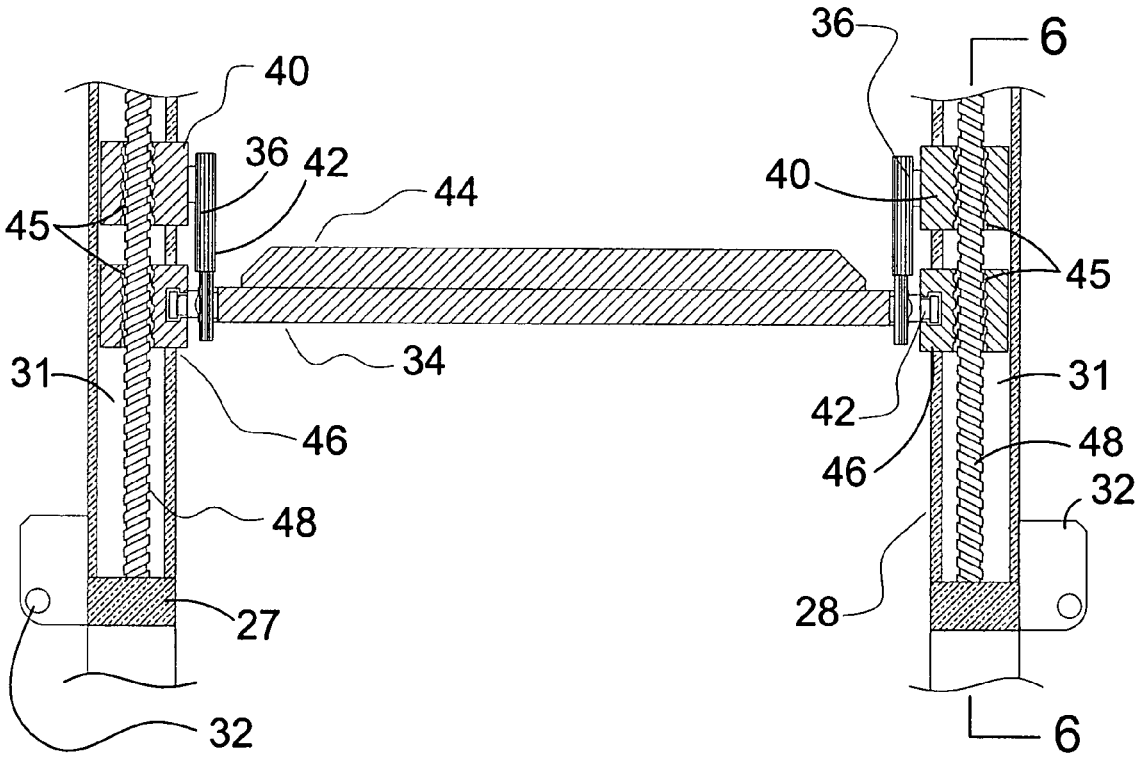
FIG. 5 is a sectional view of the motorized rungless ladder of the of the present invention taken along the line labeled 5-5 in FIG. 4.

FIG. 5 is a sectional view of the motorized rungless ladder of the of the present invention taken along the line labeled 5-5 in FIG. 4. FIG. 5 shows in detail the manner in which the drive mechanism 32 engages a worm gear 48 for causing the platform 34 to be moved along the length of the channel 31. A worm gear 48 is positioned within the channel 31 of each of the first guide rail 27 and the second guide rail 28. The drive mechanism 32 is connected to the worm gear 48 for operatively engaging the worm gear 48.

The platform 34 is shown in cross section and includes a toe guard abutment 44 which prevents the user's foot from extending beyond a safe distance on the platform 34. The elevator platform 34 is connected between the first and second guide rails, 27 and 28, respectively by the leveling device 36 and a first guide member 46 via a platform pivot 42 positioned within the channel 31. The leveling device 36 is further connected to a second guide member 40 positioned within the channel 31. Both the first guide member 46 and the second guide member 40 include a guide channel 45 extending vertically therethough. The worm gear 48 is received through the guide channel 45 of each of the first guide member 46 and second guide member 40.

The worm gear motor 32 is affixed to the ladder vertical support 28. The drive mechanism 32 causes the worm gear 48 to be engaged. The worm gear 48 once engaged by the worm gear motor 32 provides the movable elevator platform 34 with the means to traverse the length of the channel 31. The drive mechanism 32 causes the worm gear 48 to rotate in at least one of a clockwise and counterclockwise direction. Upon rotation of the worm gear 48, the first and second guide members, 46 and 40, respectively, are caused to move in a direction towards the wall brace 17 as shown in FIG. 3 thereby causing the platform 34 to be elevated. While the platform 34 is moving, the platform pivot 42 rotates the elevator platform 34 thereabout to ensure that the moveable platform 34 maintains a horizontal relation to the surface by which the ladder is supported.

Figure 6:
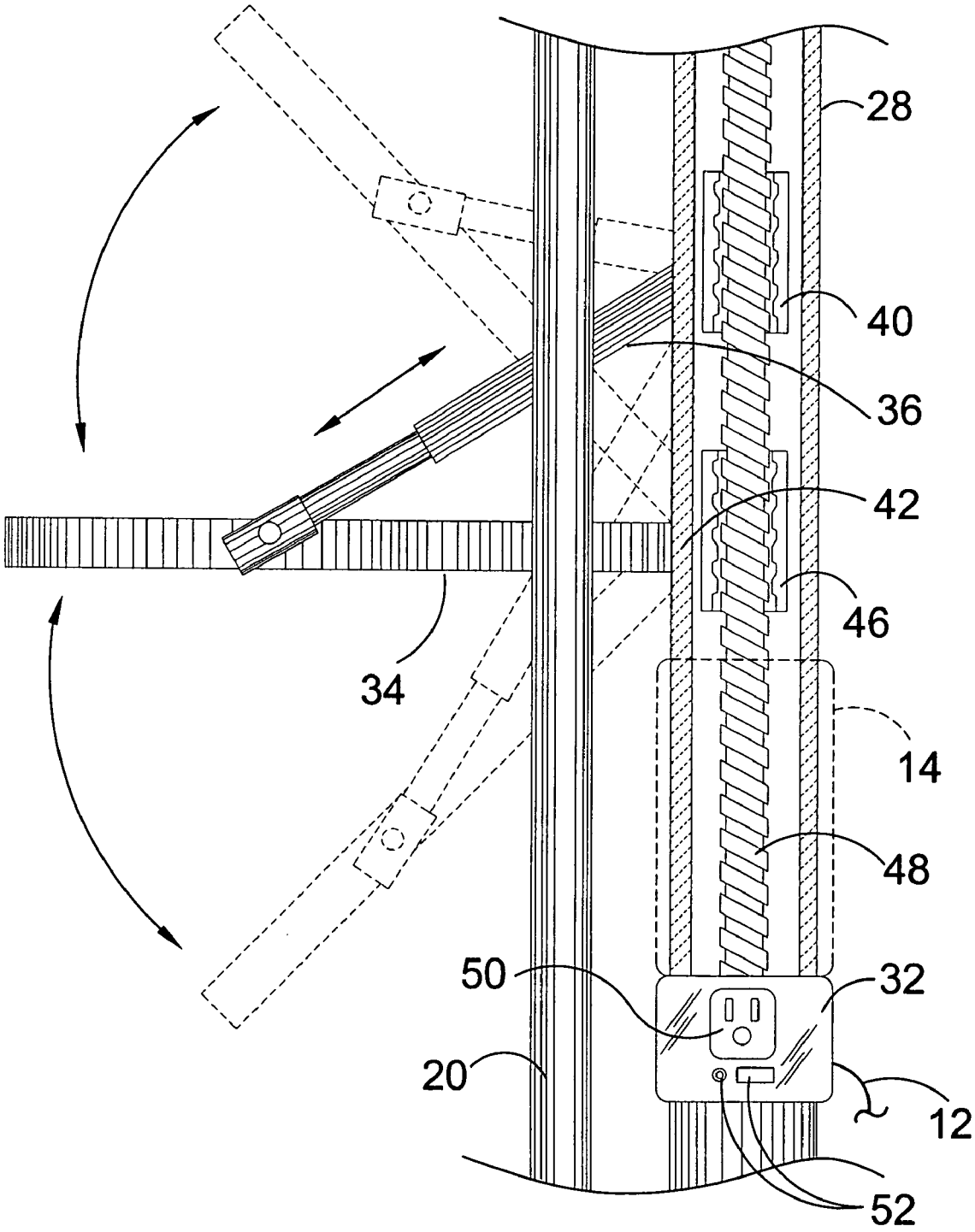
FIG. 6 is a detailed side sectional view of the motorized rungless ladder of the present invention taken along the line labeled 6-6 in FIG. 5.

FIG. 6 is a detailed side sectional view of the motorized rungless ladder of the present invention taken along the line labeled 6-6 in FIG. 5. Shown herein is a cross-section of the second guide rail 28. However, the description presented below regarding the second guide rail 28 is applicable to the first guide rail 27 which is not shown. A worm gear 48 is positioned within the channel 31 of the second guide rail 28. The drive mechanism 32 is connected to the worm gear 48 for operatively engaging the worm gear 48. The AC power cord 12 allows the user to plug the ladder into an outlet for power while the 12V vehicle adapter ports 52 allows for the ladder to be connected to a battery source (i.e. from an automobile lighter jack) for power. The AC plug port 50 allows for other tools to be plugged into the ladder socket for simultaneous use. Hand rails 20 are attached to the ladder vertical support 28 to assist the user in maintaining his balance.

The platform 34 is shown in cross section and includes a toe guard abutment 44 which prevents the user's foot from extending beyond a safe distance on the platform 34. The elevator platform 34 is connected between the first and second guide rails, 27 and 28, respectively by the leveling device 36 and a first guide member 46 via a platform pivot 42 positioned within the channel 31. The leveling device 36 is further connected to a second guide member 40 positioned within the channel 31. Both the first guide member 46 and the second guide member 40 include a guide channel 45 extending vertically therethough. The worm gear 48 is received through the guide channel 45 of each of the first guide member 46 and second guide member 40.

The worm gear motor 32 is affixed to the ladder vertical support 28. The drive mechanism 32 causes the worm gear 48 to be engaged. The worm gear 48 once engaged by the worm gear motor 32 provides the movable elevator platform 34 with the means to traverse the length of the channel 31.

The drive mechanism 32 causes the worm gear 48 to rotate in at least one of a clockwise and counterclockwise direction. Upon rotation of the worm gear 48, the first and second guide members, 46 and 40, respectively, are caused to move in a direction towards the wall brace 17 as shown in FIG. 3 thereby causing the platform 34 to be elevated. While the platform 34 is moving, the platform pivot 42 rotates the elevator platform 34 thereabout to ensure that the moveable platform 34 maintains a horizontal relation to the surface by which the ladder is supported.

Figure 7:
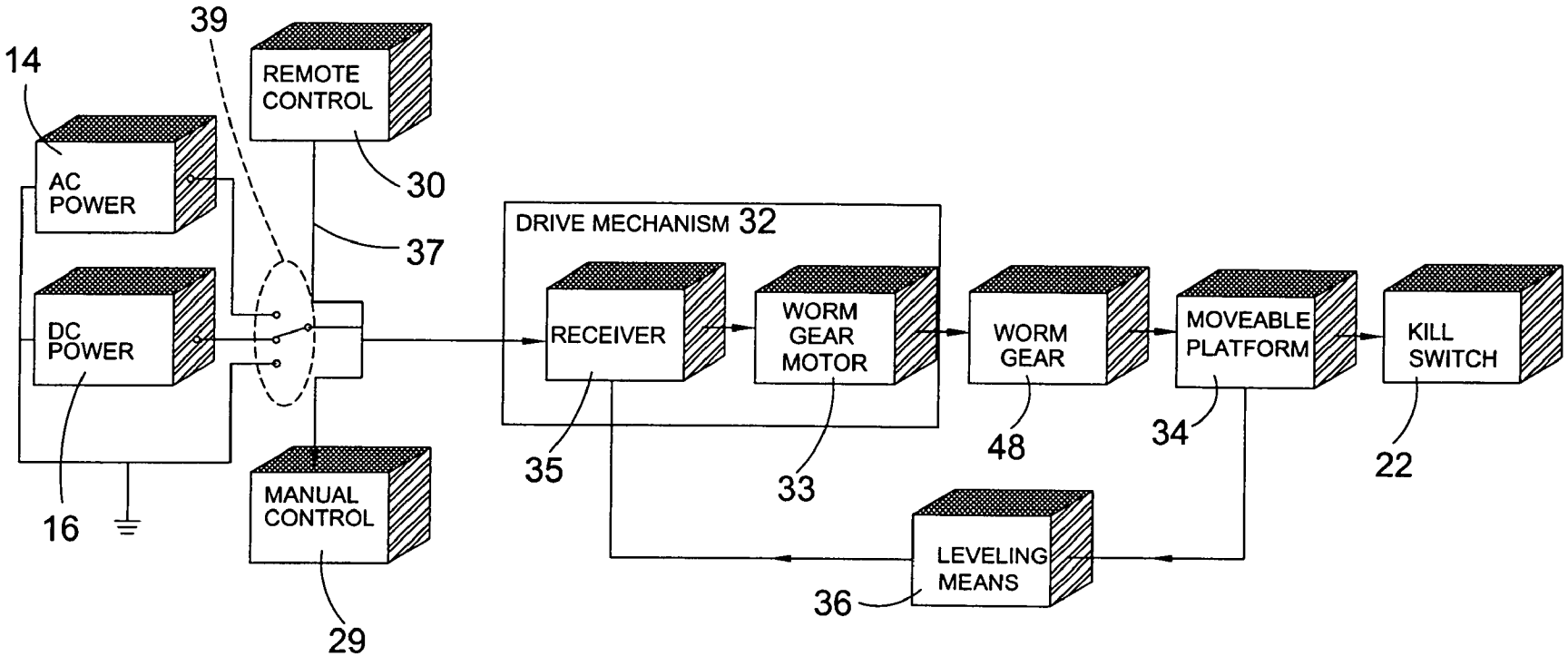
FIG. 7 is a block diagram depicting the control system for operating the motorized rungless ladder of the present invention.

FIG. 7 is a block diagram depicting the control system for operating the motorized rungless ladder of the present invention. The motorized ladder 10 receives at receiver 35 of the drive mechanism 32 a control signal 37 from at least one of a manual control 29 and the remote control device 30. Once the signal 37 is received, the receiver 35 activates the worm gear motor 33. The worm gear motor 32 drives the worm gear 48 which causes the elevator platform 34 to move along the length of the channel 31 as shown in FIGS. 1-6. As the elevator platform 34 is moves, the platform 34 leveling device 36 and platform pivoting means 42 shown in FIGS. 5 and 6 ensure that the elevator platform 34 maintains a horizontal relation to the surface in which the ladder is support by. If the elevator platform 34 exceeds a certain height, the kill switch 22 is activated, thereby shutting down the motor 33 and preventing the elevator platform 34 from moving.

Figure 8:
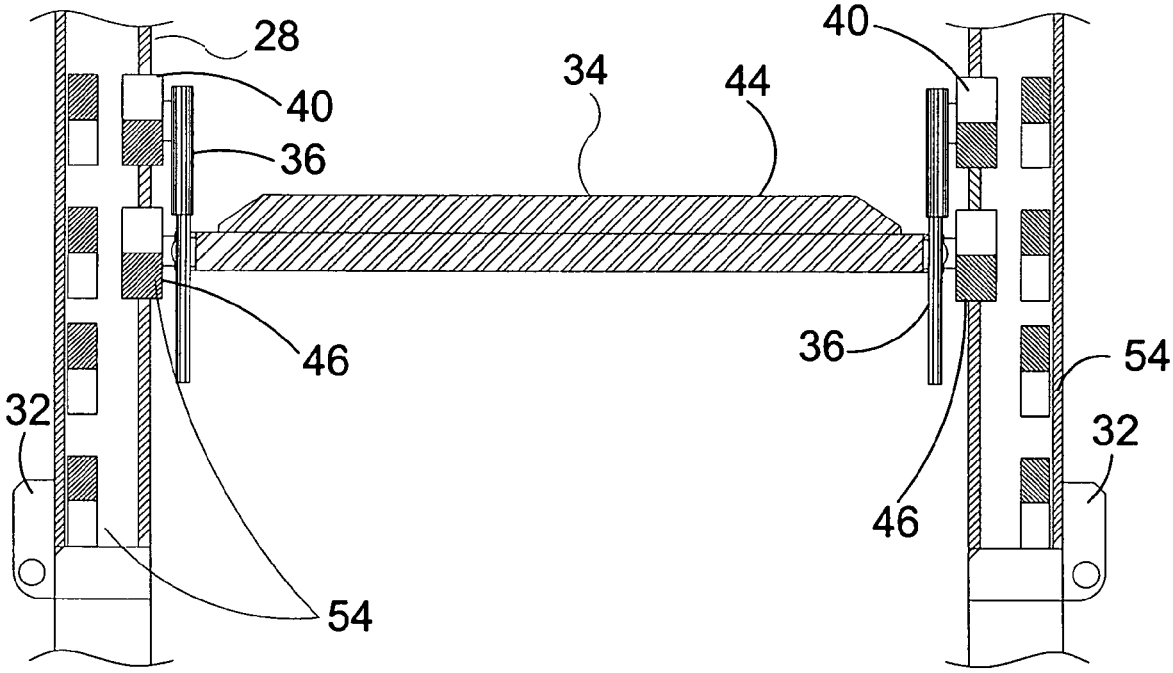
FIG. 8 is a sectional view of an alternate embodiment of the motorized rungless ladder of the present invention taken along the line labeled 5-5 in FIG. 4.

FIG. 8 is a sectional view of an alternate embodiment of the motorized rungless ladder of the present invention taken along the line labeled 5-5 in FIG. 4. This alternate embodiment uses a different mechanism for moving the platform 31 along the length of the channel 31. The platform 34 is caused to moved by shifting the polarity of a plurality of electromagnets 54.

A plurality of electromagnets 54 are positioned along the length of the channel 31 of each of the first guide rail 27 and second guide rail 28. The first and second guide members 46 and 40, respectively, connect the platform 34 between the guide rails 27,28. However, in this embodiment, the guide members 46, 40 are also electromagnets 54. The first guide member connects the platform 34 within the channel 31 and the second guide member connects the leveling device 36 between the platform 34 and the channel 31. Also attached to the elevator platform 34 is the toe guard abutment 44.

The drive mechanism 32 controls the polarity of each electromagnet 54 thereby ensuring that the guide members 46, 40 stay at a predetermined distance from the electromagnets 54 in the channel 31. As the polarity of the magnets along the channel 31 changes, it repulses the electromagnets 54 attached to the first and second guide members, 46 and 40, respectively, and causes the elevator platform 34 to move along the length of the channel 31.

Figure 9:
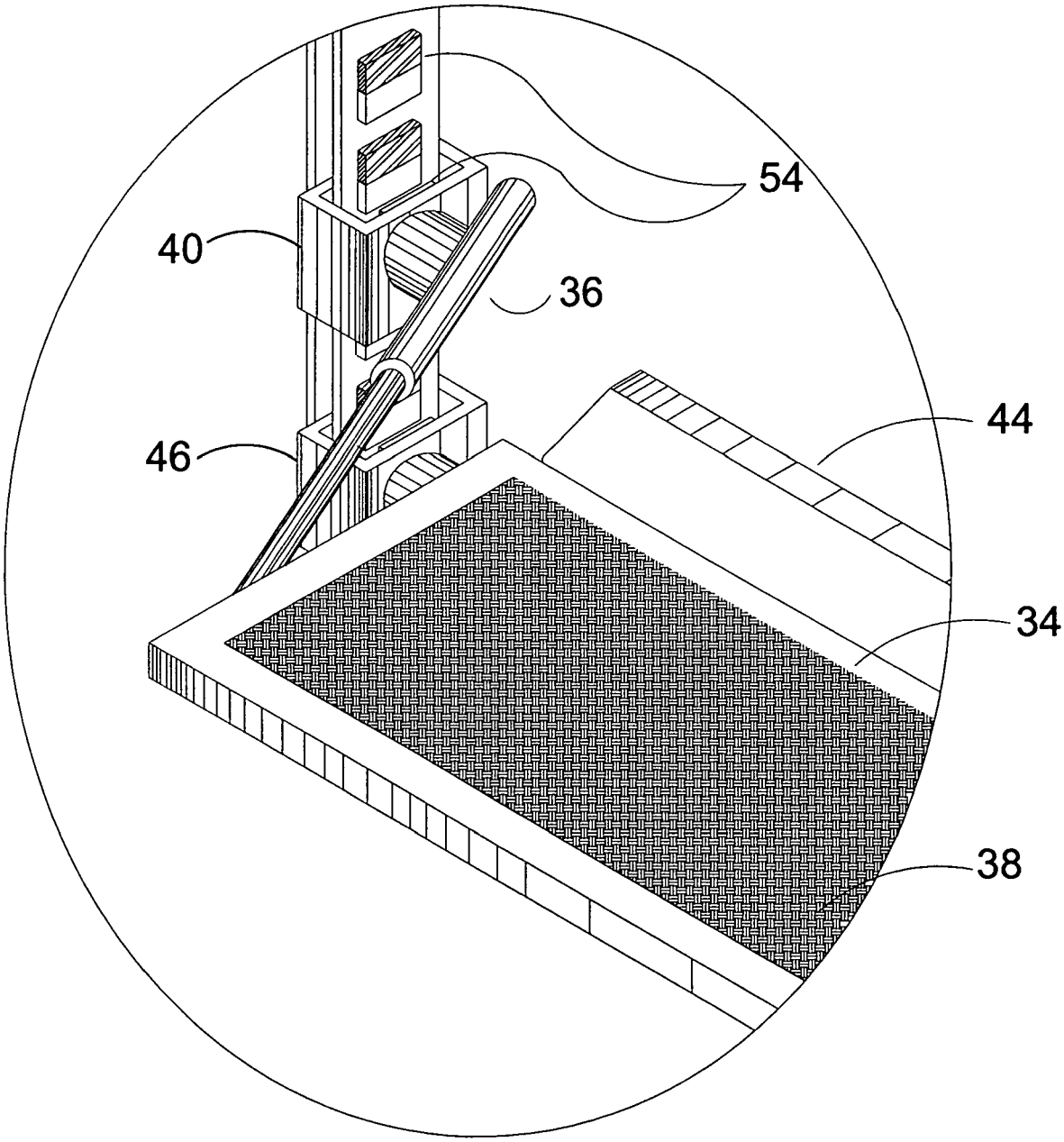
FIG. 9 is a enlarged view of the alternate embodiment of the elevator platform of the motorized rungless ladder of the present invention.

FIG. 9 is a enlarged view of the alternate embodiment of the elevator platform of the motorized rungless ladder of the present invention. A plurality of electromagnets 54 are positioned along the length of the channel 31 of each of the first guide rail 27 and second guide rail 28. The first and second guide members 46 and 40, respectively, connect the platform 34 between the guide rails 27,28. However, in this embodiment, the guide members 46, 40 are also electromagnets 54. The first guide member connects the platform 34 within the channel 31 and the second guide member connects the leveling device 36 between the platform 34 and the channel 31. Also attached to the elevator platform 34 is the toe guard abutment 44.

The drive mechanism 32 controls the polarity of each electromagnet 54 thereby ensuring that the guide members 46, 40 stay at a predetermined distance from the electromagnets 54 in the channel 31. As the polarity of the magnets along the channel 31 changes, it repulses the electromagnets 54 attached to the first and second guide members, 46 and 40, respectively, and causes the elevator platform 34 to move along the length of the channel 31.

Figure 10:
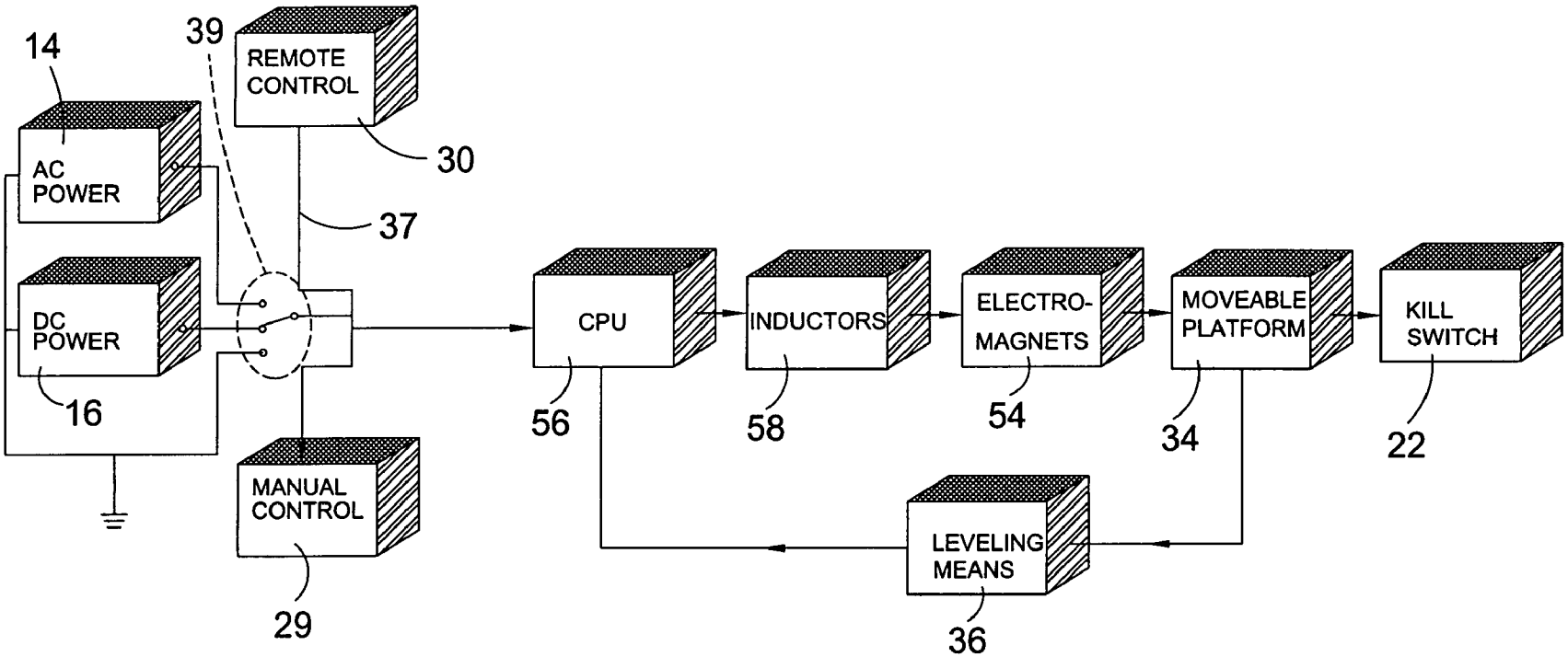
FIG. 10 is a block diagram of the control mechanism operating the motorized electromagnetic rungless ladder of the present invention.

FIG. 10 is a block diagram of the control mechanism operating the motorized electromagnetic rungless ladder of the present invention. The motorized ladder 10 receives a control signal 37 from at least one of a manual control 29 or the remote control device 30. Once the signal 37 is received, the processor 56 causes an inductor 58 to control the polarity of the electromagnets 54 within the channel 31. The selected polarity of the electromagnets 54 raises or lowers the elevator platform 34 by means of magnetic repulsion. As the elevator platform 34 is raised or lowered, the platform leveling device 36 and platform pivoting means 42 ensure that the elevator platform maintains a horizontal relation to the surface in which the ladder is support by. If the elevator platform 34 exceeds a certain height, the kill switch 22 is activated, thereby maintaining a specific polarity and locking the platform 34 in place.

It will be understood that each of the elements described above, or two or more together may also find a useful application in other types of devices differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A device supported by a ground surface and a structure for at least one of elevating and descending a user comprising:

a. a first guide rail having a first channel extending along a length thereof;

b. a second guide rail having a second channel extending along the length thereof;

c. at least one connector for connecting said first guide rail with said second guide rail at a predetermined location along a length thereof so that said first channel and said second channel face inwards towards each other;

d. a platform for supporting the user having a predetermined amount of weight, said platform is connected within each of said first and second channels and between said first guide rail and second guide rail;

e. means for moving said platform along said length of each of said first channel and said second channel, wherein upon said moving means being engaged by a user, said platform is moved distally towards at least one of a first end of said guide rails and a second end of said guide rails opposite said first end thereby moving said user therealong; and f. a leveling device for connecting said platform within each of said first channel and said second channel.

2. The device as recited in claim 1, wherein said moving means is a worm gear and a motor operatively connected to said worm gear for causing said worm gear to rotate at least one of a first clockwise direction and a second counterclockwise direction.

3. The device as recited in claim 1, wherein said leveling device causes said platform to extend at a predetermined angle in relation to the structure by which said device is supported.

4. The device as recited in claim 3, further comprising a first guide member for connecting said leveling device within each of said first channel and said second channel.

5. The device as recited in claim 4, further comprising a second guide member for pivotally connecting said platform within each of said first channel and said second channel.

6. The device as recited in claim 5, wherein said moving means is a worm gear and a motor for engaging said worm gear thereby causing said worm gear to rotate in at least one of a clockwise and counterclockwise direction.

7. The device as recited in claim 6, where each of said first guide member and said second guide member further include a guide channel extending vertically therethrough along a length thereof.

8. The device as recited in claim 7, wherein said worm gear is received through each of said guide channels, wherein upon said rotation thereof, said first and said second guide members are caused to move in a direction of at least one of said first distal end and said second distal end.

9. The device as recited in claim 1, further comprising a plurality of electromagnets positioned along said length of each of said first channel and said second channel.

10. The device as recited in claim 9, further comprising a leveling device connected to said platform and within each of said first channel and said second channel.

11. The device as recited in claim 10, further comprising a first guide member for connecting said level device within each of said first channel and said second channel.

12. The device as recited in claim 11, wherein said first guide member includes an electromagnet positioned on a first side thereof, wherein said electromagnet on said first guide member face said plurality of said electromagnets in one of said first channel and said second channel.

13. The device as recited in claim 12, further comprising a second guide member for pivotally connected said platform within one of said first channel and said second channel.

14. The device as recited in claim 13, wherein said second guide member includes an electromagnet positioned on a first side thereof, wherein said electromagnet on said first guide member face said plurality of said electromagnets in one of said first channel and said second channel.

15. The device as recited in claim 14, wherein said moving means selectively changes the polarity of said plurality of electromagnets within one of said first channel and said second channel thereby repelling said first and second guide member in a direction towards one said first distal end and said second distal end.

16. The device as recited in claim 10, wherein said leveling device causes said platform to extend at a predetermined angle in relation to the structure by which said device is supported.

17. The device as recited in claim 1, further comprising a tilt sensor positioned at said first distal end for sensing if a tilt level of said device is greater than or equal to a predetermined unacceptable tilt level.

18. The device as recited in claim 17, further comprising an alert mechanism connected to said tilt sensor for alerting said user that said sensed tilt level is greater than or equal to a predetermined unacceptable tilt level.

19. The device as recited in claim 1, further comprising a kill switch mechanism positioned at one of said first distal end and said second distal end for preventing said moving means from moving said platform.

20. The device as recited in claim 1, further comprising a remote control unit for selectively controlling said moving means.

21. The device as recited in claim 1, wherein said device is a rungless ladder.

22. A device supported by a sound surface and a structure for at least one of elevating and descending a user comprising:

a. a first guide rail having a first channel extending along a length thereof;

b. a second guide rail having a second channel extending along the length thereof;

c. at least one connector for connecting said first guide rail with said second guide rail at a predetermined location along a length thereof so that said first channel and said second channel face inwards towards each other d. a platform for supporting the user having a predetermined amount of weight, said platform is connected within each of said first and second channels and between said first guide rail and second guide rail;

e. means for moving said platform along said length of each of said first channel and said second channel, wherein upon said moving means being engaged by a user, said platform is moved distally towards at least one of a first end of said guide rails and a second end of said guide rails opposite said first end thereby moving said user therealong; and f. wherein said moving means is an electromagnetic propulsion means whereby upon changing a polarity of a plurality of electromagnets, said platform is caused to move in the direction of at least one of said first distal end and said second distal end.

23. A device supported by a ground surface and a structure for at least one of elevating and descending a user comprising:

a. a first guide rail having a first channel extending along a length thereof;

b. a second guide rail having a second channel extending along the length thereof;

c. at least one connector for connecting said first guide rail with said second guide rail at a predetermined location along a length thereof so that said first channel and said second channel face inwards towards each other;

d. a platform for supporting the user having a predetermined amount of weight, said platform is connected within each of said first and second channels and between said first guide rail and second guide rail;

e. means for moving said platform along said length of each of said first channel and said second channel, wherein upon said moving means being engaged by a user, said platform is moved distally towards at least one of a first end of said guide rails and a second end of said guide rails opposite said first end thereby moving said user therealong; and f. manual kill switch positioned on said at least one connector, wherein said user can manually depress said kill switch and prevent said moving means from moving said platform.

* * * * *